US005633627A

United States Patent [19]

Newham

[11] Patent Number: 5,633,627

[45] Date of Patent: May 27, 1997

[54] HARD-WIRED MONITORING SYSTEM FOR HOSPITAL BED OR SHORT TERM CARE PATIENTS

[75] Inventor: Paul F. Newham, San Antonio, Tex.

[73] Assignee: Bed-Check Corporation, Tulsa, Okla.

[21] Appl. No.: 311,588

[22] Filed: Sep. 23, 1994

[51] Int. Cl.[6] ..... G08B 23/00

[52] U.S. Cl. ..... 340/573; 340/529; 340/666

[58] Field of Search ..... 340/573, 529, 340/523, 667, 666, 693; 200/85 R, 85 A

[56] References Cited

U.S. PATENT DOCUMENTS

| | | | |
|---|---|---|---|
| 4,484,043 | 11/1984 | Musick et al. | 200/85 R |
| 4,565,910 | 1/1986 | Musick et al. | 200/85 R |
| 4,633,237 | 12/1986 | Tucknott et al. | 340/573 |
| 5,235,319 | 8/1993 | Hill et al. | 340/573 |
| 5,276,432 | 1/1994 | Travis | 340/573 |
| 5,410,297 | 4/1995 | Joseph et al. | 340/573 |

FOREIGN PATENT DOCUMENTS

| | | | |
|---|---|---|---|
| 9010281 | 9/1990 | WIPO | 340/573 |

*Primary Examiner*—Thomas Mullen
*Attorney, Agent, or Firm*—Frank J. Catalano; Scott R. Zingerman

[57] ABSTRACT

A system connectible to an electrical power source for monitoring a short term care device having a sensor thereon for detecting the presence of a patient on the device includes a microprocessor and a plurality of circuits connected to the microprocessor. A first circuit connected to the microprocessor and to the sensor automatically initiates operation of the microprocessor upon detection by the sensor of the patient's presence on the device. A second circuit connected to the microprocessor provides an alarm upon demand by the microprocessor. A third circuit connected to the microprocessor is adapted to be interfaced with a nurse call station for generating signals to the station upon demand by the microprocessor. A fourth circuit connected to the microprocessor programs the system in response to commands manually applied to the fourth circuit. The interrelationship of the resident program with the manual commands permits the system to activate to a "monitor" mode after a predetermined time delay following detection by the sensor of the patient's presence on the device, to deactivate to a "hold/reset" mode after the system has been activated to the "monitor" mode and to trigger to the "alarm" mode when the patient's presence on the device terminates while in the "monitor" mode.

19 Claims, 5 Drawing Sheets

HARD-WIRED MONITORING SYSTEM FOR HOSPITAL BED OR SHORT TERM CARE PATIENTS

BACKGROUND OF THE INVENTION

This invention relates generally to systems for monitoring the presence or absence of a patient in or from a hospital bed, patient chair or the like and more particularly concerns monitoring systems having programmable capability to tailor the system functions to meet the needs of specific hospital or short term care monitoring applications.

Presently known monitoring systems, such as those described in earlier U.S. Pat. Nos. 4,484,043 and 4,565,910, have serious limitations of function and operating capability. They make no provision for ready interfacing with the variety of nurse call station configurations in different and even in the same hospital facilities. They may require the manual operation of on/off switches to activate the monitoring process. Once activated they must then be shut down completely to enable a nurse to move a patient and then manually switched on to reactivate the device after return of the patient. They are not locally modifiable by the monitoring staff to accommodate the needs of a particular patient and/or environment. They generally offer no selection of tonal variations in their audio alarm and no selection of time delay increments required to trigger their alarm modes. Furthermore, even in those systems which do permit some time delay adjustment, the system remains in the last time delay mode to which it was adjusted until an active readjustment of the selected delay is made. Consequently, failure to actively adjust the time delay from a previously selected increment could have an undesirable impact on a different patient or environment. A further problem encountered in present monitoring systems is that they employ their on/off switch controls in such a manner that loss of power or inadvertent disconnection from the nurse call station does not cause an alarm. Therefore, the monitoring staff has no assurance that a patient is actually being monitored without repetitive local inspection to assure that the system is properly connected and operable.

It is, therefore, one of the primary objects of this invention to provide a system which is suitable to monitor short term and/or hospital care patients. Another object of this invention is to provide a patient monitoring system which can be readily interfaced with a variety of nurse call station configurations. Still another object of this invention is to provide a patient monitoring system which is programmable on-site by monitoring personnel to adapt the system to each specific patient and environment. It is also an object of this invention to provide a patient monitoring system which is activated by initial pressure on a sensor device for a predetermined continuous time period rather than by the use of on/off switches. A further object of this invention is to provide a patient monitoring system which can be temporarily deactivated to a "hold" mode by use of a single hold/reset control on the unit and which will be automatically reactivated to a "monitor" mode when the patient is returned to the system for a predetermined continuous time period. Another object of this invention is to provide a patient monitoring system which can be immediately activated to override a predetermined delay so as to prevent a quick moving patient from defeating the system. Yet another object of this invention is to provide a patient monitoring system in which disconnection of the system from the sensor device, from power or from the nurse call station will result in a failsafe alarm. A further object of the present invention is to provide a patient monitoring system which, in its programmable functions, includes variations of type and volume of alarm tones. It is also an object of this invention to provide a patient monitoring system which permits active selection of time delay increments required before triggering of an alarm and also automatically defaults to a "normal" preselected time delay if a different delay period is not actively selected. And it is an object of this invention to provide a patient monitoring system which provides on-site ability to adapt the system to any of a variety of nurse call station configurations.

SUMMARY OF THE INVENTION

In accordance with the invention, a system connectible to an electrical power source for monitoring a short term care device having a sensor thereon for detecting the presence of a patient on the device includes a microprocessor and a plurality of circuits connected to the microprocessor. A first circuit connected to the microprocessor and to the sensor automatically initiates operation of the microprocessor upon detection by the sensor of the patient's presence on the device. A second circuit connected to the microprocessor provides an alarm upon demand by the microprocessor. A third circuit connected to the microprocessor is adapted to be interfaced with a nurse call station for generating signals to the station upon demand by the microprocessor. A fourth circuit connected to the microprocessor programs the system in response to commands manually applied to the fourth circuit.

The microprocessor is responsive to a program resident therein to activate the system to a "monitor" mode after a predetermined time delay following detection by the sensor of the patient's presence on the device and is responsive to a first manually operable switch in the fourth circuit to deactivate the system to a "hold/reset" mode after the system has been activated to the "monitor" mode. The microprocessor is further responsive to the first manually operable switch in the fourth circuit to activate the system to the "monitor" mode immediately after detection by the sensor of the patient's presence on the device and manual operation of the first switch and to deactivate the system to the "hold/reset" mode for a predetermined period of time following activating of the system and manual operation of the first switch. The fourth also provides different visual indications when the system is in the "monitor" mode or in the "hold/reset" mode.

The microprocessor also is responsive to the first circuit to activate the system to the "monitor" mode after the system has been deactivated to the "hold/reset" mode with subsequent sequential detection by the sensor of the patient's presence on the device, termination of the patient's presence on the device and resumption of the patient's presence on the device. In addition, the microprocessor is responsive to the first circuit to activate the system to the "monitor" mode after the system has been deactivated to the "hold/reset" mode with subsequent continuous detection by the sensor of the patient's presence on the device for the necessary predetermined period of time.

The microprocessor is responsive to the first circuit to switch the system from the "monitor" mode to an "alarm" mode and trigger the second circuit to provide an alarm a predetermined time after detection by the sensor of termination of the patient's presence on the device. The fourth circuit provides a visual indication when the system is in the "alarm" mode. The microprocessor is sequentially responsive to a second manual switch in the fourth circuit to select the necessary predetermined time from a plurality of preselected different times and the fourth circuit provides a visual indication of which predetermined time has been selected. The microprocessor is further responsive to the fourth circuit to always default the second switch to the same predetermined time when the system has been disconnected from the electrical power source.

The microprocessor is responsive to the first manual switch in the fourth circuit to switch the system from the "alarm" mode to the "hold/reset" mode and disarm the second circuit to cease the alarm when the system is in the "alarm" mode and the first manual switch is operated.

The second circuit includes a plurality of components switchably connectable between the microprocessor and the alarm device to provide different input signals to the alarm device while a fifth circuit has a plurality of switches connected to the microprocessor for manually programming the microprocessor. The microprocessor is responsive to the manual programming of the fifth circuit to connect corresponding ones of the signal providing components to the alarm device and thus permit selection of the alarm signal given.

The third circuit has components switchably connectable between the microprocessor and the nurse call station to adapt the system for electrical interfacing with a selected one of pulsed, continuous and one-shot nurse call station configurations while the fifth circuit means has another plurality of switches connected to the microprocessor for manually programming the microprocessor. The microprocessor is responsive to the manual programming of the fifth circuit to adapt the system for electrical interfacing with a selected one of the nurse call station configurations.

Finally, the microprocessor is responsive to disconnection of the first circuit from the microprocessor after the system is activated to the "monitor" mode to cause the second circuit to generate an alarm. Disconnection of the first circuit will occur if the system is disconnected from the electrical power source, the sensor is disconnected from the first circuit or the nurse call station is disconnected from the third circuit.

BRIEF DESCRIPTION OF THE DRAWINGS

Other objects and advantages of the invention will become apparent upon reading the following detailed description and upon reference to the drawings in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
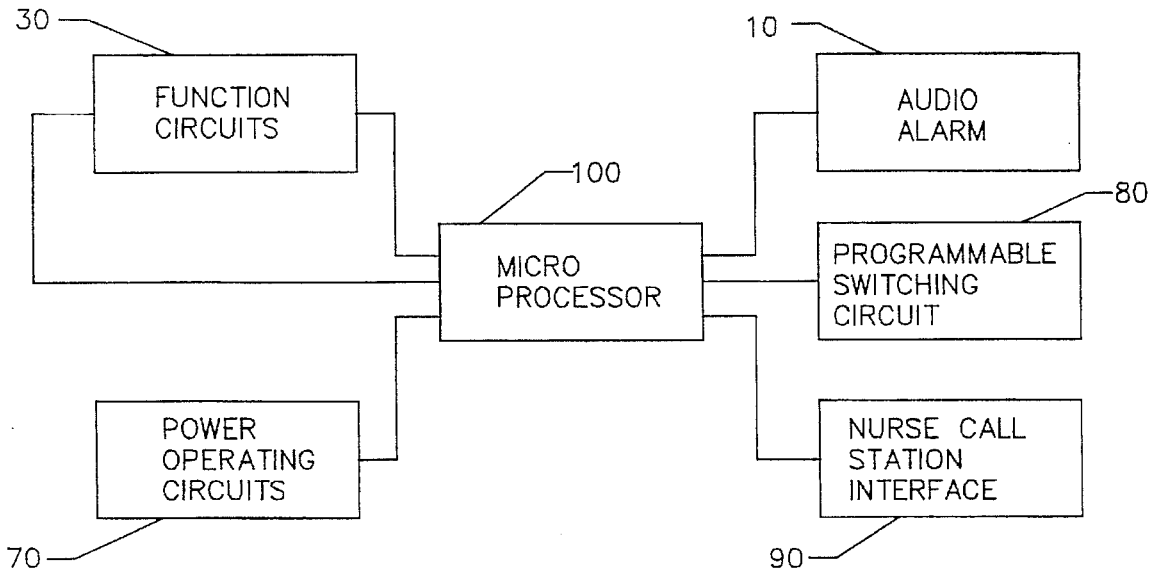
FIG. 1 is a block diagram of a preferred embodiment of the patient monitoring system.

Turning first to FIG. 1, the patient monitoring system includes an audio alarm circuit 10, a function circuit 30, a power operating circuit 70, a programmable switching circuit 80, a nurse call station interface 90 and a microprocessor 100 connected in configuration and for operation as hereinafter explained.

Figure 2:
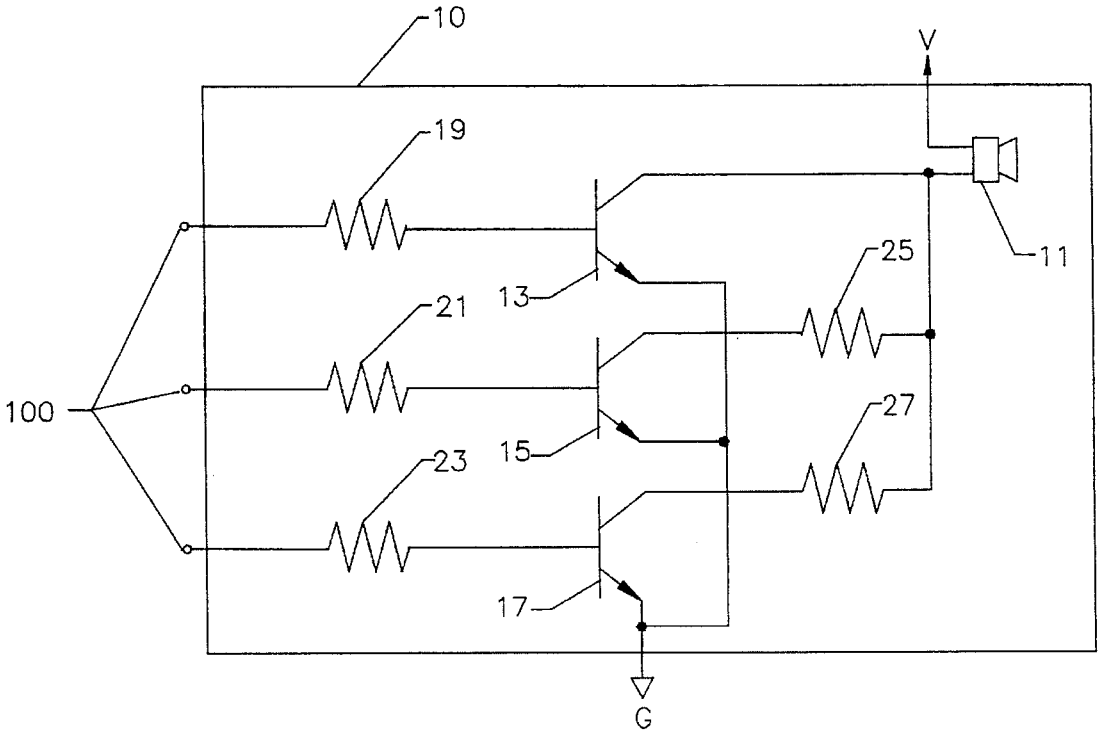
FIG. 2 is a schematic diagram of a preferred embodiment of an audio alarm circuit of the patient monitoring system.

The audio alarm circuit 10 is shown in detail in FIG. 2 and includes an audio alarm 11 connected between a voltage source V and ground G. Three transistors 13, 15 and 17 have their bases connected through three resistors 19, 21 and 23 to output terminals on the microprocessor 100. The emitter of each of the transistors 13, 15 and 17 is connected to ground G. The collector of the first transistor 13 is connected directly to the audio alarm 11 to provide the highest level audio alarm. The collector of the second transistor 15 is connected through a resistor 25 to the audio alarm 11 to provide an intermediate level audio alarm. The collector of the third transistor 17 is connected through another resistor 27 having resistance greater than the resistance of the second transistor resistor 25 to the audio alarm 11 to provide the lowest level of audio alarm. Thus, the audio alarm level is selectable under the control of the microprocessor 100.

Figure 3:
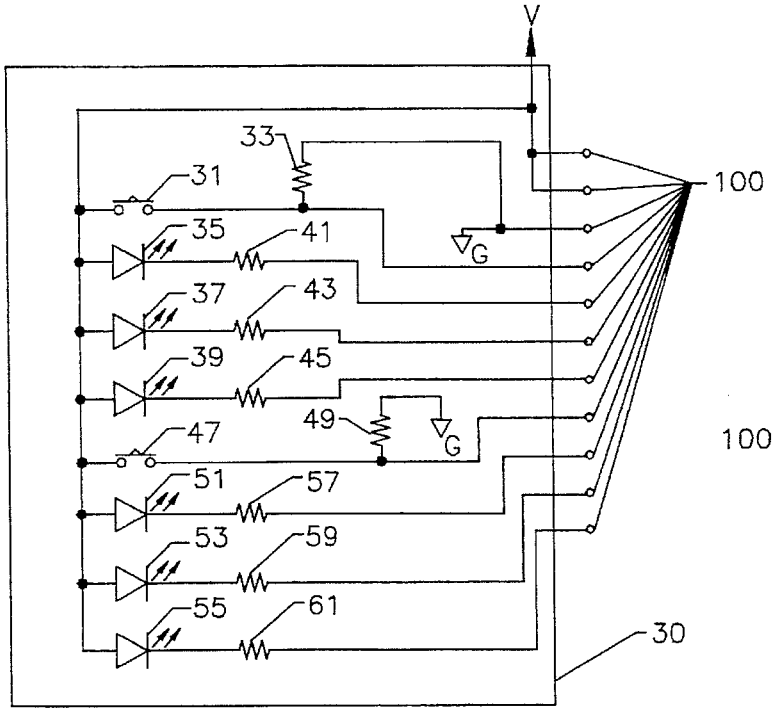
FIG. 3 is a schematic diagram of a preferred embodiment of the "function" alarm circuit of the patient monitoring system.

Turning to FIG. 3, the function circuit 30 of the patient monitoring system is shown in detail. The voltage source V is connected to two terminals of the microprocessor 100. A hold/reset switch 31 is connected on one side to the voltage source V and on its other side through a resistor 33 to ground and to another terminal of the microprocessor 100 and also directly to another terminal of the microprocessor 100. Three LED's 35, 37 and 39 are also connected on one side to the voltage source V and on their other side through respective resistors 41, 43 and 45 to three separate terminals of the microprocessor 100. One LED 35 provides a visual indication, preferably green, that the system is in a "monitor" mode. The second LED 37 provides a visual indication, preferably amber, that the system is in a "hold/reset" mode and the third LED 39 provides a visual indication, preferably red, that the system is in an "alarm" mode. The function circuit 30 also includes a second switch 47 connected on one side to the voltage source V and on the other side to ground G through a resistor 49 and also to another terminal of the microprocessor 100. The second switch 47 permits selection of the delay time that will occur between a triggering event and triggering of the alarm. In conjunction with this second switch 47 three more LED's 51, 53 and 55 are connected on one side to the voltage source V and on their other side through resistors 57, 59 and 61, respectively, to three separate terminals of the microprocessor 100. Each LED 51, 53 and 55 is associated with a numerical indicator of the selected time delay. The LED circuit is sequentially scrolled through the possible time delays by repeated operation of the second switch 47. Preferably, there will also be a tone emitted each time the second switch 47 is pressed.

Figure 4:
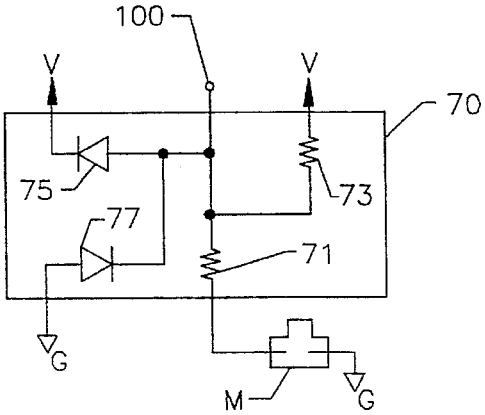
FIG. 4 is a schematic diagram of a preferred embodiment of the sensor circuit of the patient monitoring system.

Turning now to FIG. 4, the power operating circuit 70 of the patient monitoring system is illustrated. A monitoring sensor device such as a pressure sensitive mat M is connected on one side to ground G and on its other side through a resistor 71 to a terminal of the microprocessor 100 and also through the resistor 71 and a second resistor 73 to the voltage source V. Thus, the grounding of the circuit by application of pressure to the mat M by the presence of the patient causes a signal to be delivered to the microprocessor 100 and activates the system after lapse of a predetermined built-in time delay, preferably approximately 10 seconds, or after manual override of the time delay, whichever first occurs. This terminal of the microprocessor 100 is connected via one diode 75 to the voltage source V and via a second diode 77 to ground to provide static protection to the microprocessor 100.

Figure 5:
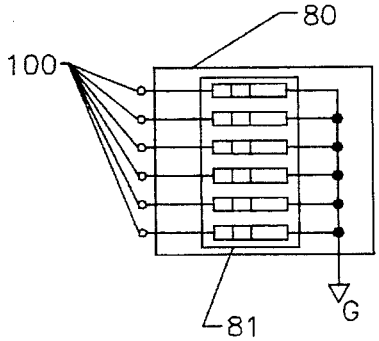
FIG. 5 is a schematic diagram of a preferred embodiment of the programmable switching circuit of the patient monitoring system.

Turning now to FIG. 5, the programmable switching circuit 80 of the patient monitoring system is seen to include six two position switches 81, each connected on one side to ground G and on the other side each separately connected to a different terminal of the microprocessor 100. Thus, monitoring personnel can vary the functional operation of the system by reprogramming the microprocessor 100 via the programmable switching circuit 80. Preferably, the switches 81 are internal to the system enclosure, but they may be externally accessible. In one preferred embodiment of the patient monitoring system, the switch configurations permit selection of pulsed, continuous or one shot relay nurse call closures as will be hereinafter discussed, as well as off, soft or loud audio levels and a pulsed or continuous alarm response.

Figure 6:
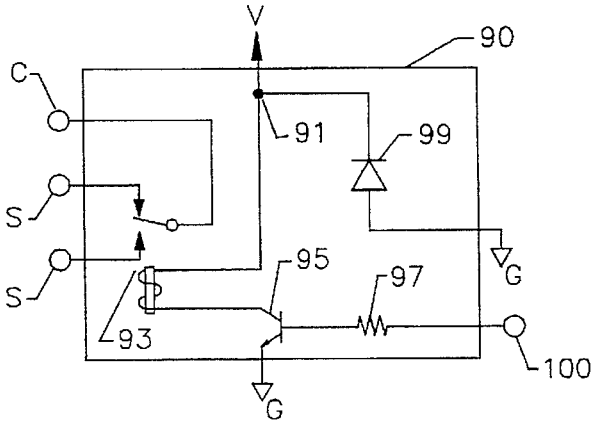
FIG. 6 if a schematic diagram of the preferred embodiment of the monitoring station interface circuit of the patient monitoring system.

Looking at FIG. 6, the nurse call station interface circuit 90 is illustrated. A 12 volt DC source 91 is connected to one side of the coil of a relay switch 93 which has its other side connected through a transistor 95 to ground G. The base of the transistor 95 is connected through a resistor 97 to a terminal of the microprocessor 100. The 12 volt source 91 is also connected through a diode 99 to ground G. The switching portion of the relay switch 93 has its common terminal C and both of its switching terminals S separately externally accessible for connection to the nurse call station (not shown). Depending on the configuration of the nurse call station, the previously discussed setting of the programmable switching circuit 80 will appropriately connect the interface circuit 90, thus permitting the system to be readily used with all known possible nurse call station configurations, be they normally open, normally closed or one shot type systems.

Figure 7:
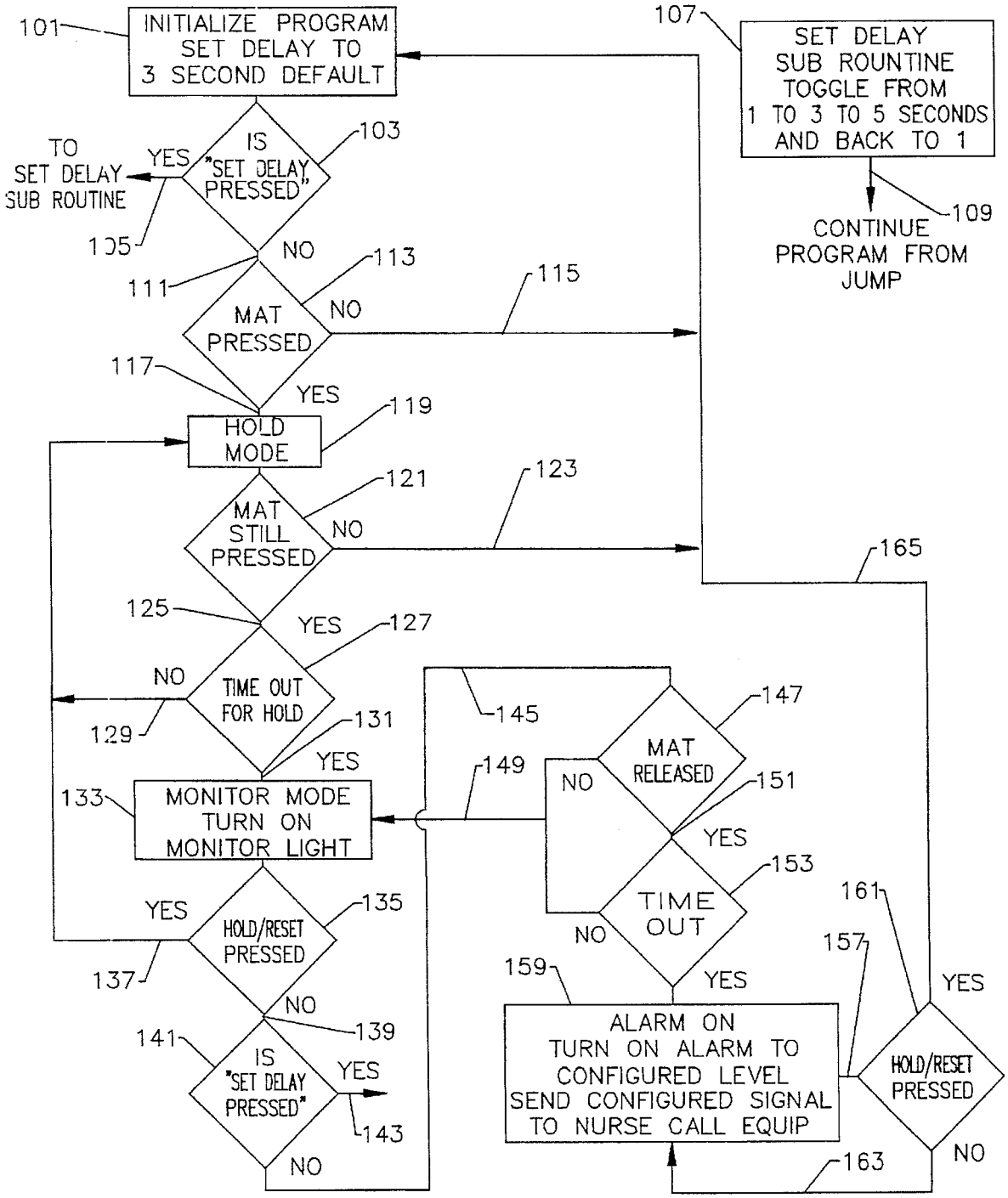
FIG. 7 is a flow chart of a preferred embodiment of the operation of the digital monitoring system under the control of the microprocessor and its associated software.

Turning now to FIG. 7, the preferred operational sequence of the patient monitoring system under the control of the internal software of the microprocessor 100 is illustrated. With the system fully connected and before any pressure is applied to the mat M, the program is initialized and the delay set to a three second default 101. The routine then inquires as to whether the set delay switch 47 has been pressed 103. If the response to this inquiry is "YES" 105, the system proceeds to a set delay subroutine 107 in which toggling of the set delay switch 47 scrolls the delay period from preferably one to three to five seconds and back to one. When the desired delay has been selected, the routine returns to continue the program from jump 109. The LED's 51, 53 and 55 of the set delay circuit indicate which time delay has been selected. If the response to the set delay pressed inquiry 103 is "NO" 111, then the routine continues to a mat pressed inquiry 113. If the response to this inquiry is "NO" 115, then the routine continues in a loop back to the set delay pressed inquiry 103. If the response to the mat pressed inquiry 113 is "YES" 117, then the routine proceeds to a hold mode 119 for the time delay built into the system to occur between application of pressure to the mat and activation of the system, preferably approximately ten seconds. In the hold mode 119, the routine next inquires whether the mat is still pressed 121. If the response to this inquiry is "NO" 123, the routine loops back to the set delay pressed inquiry 103. If the response to the mat still pressed inquiry 121 is "YES" 125, the routine next inquires at a time out for hold 127 as to whether the delay time has been exceeded. As long as the answer to this inquiry is "NO" 129, the routine continues to loop through the hold mode position 119. If, however, the answer to the inquiry is "YES" 131, the routine proceeds to the monitor mode 133 and turns on the monitor LED 35, preferably green, to indicate that the system is in the monitoring condition. Once in the monitor mode 133, the routine next inquires as to whether the hold/reset button 31 has been pressed 135. If the answer to this inquiry is "YES" 137, then the routine returns to the hold mode 119 to restart the cycle. If, however, the answer to this inquiry is "NO" 139, then the routine continues to inquire for a second time as to whether set delay is pressed 141. If the answer to this inquiry is "YES" 143, the system proceeds to the set delay subroutine 107. If the answer to this inquiry is "NO" 145, the routine proceeds to a mat released inquiry 147. If the answer to this inquiry is "NO" 149, the routine returns to the monitor mode 133. If the answer to this inquiry is "YES" 151, the routine proceeds to a time-out inquiry 153 to determine whether the set delay time has elapsed. If the delay time has not elapsed, the answer to this inquiry is "NO" 155 and the routine returns to the monitor mode 133. If the answer to this inquiry is "YES" 157, then the routine proceeds to an alarm on mode 159, where the alarm is given according to the configuration, level, type and location established by the system's programmable circuits. With the alarm on 159, the routine next inquires as to whether or not the hold/reset has been pressed 161. If the response to this inquiry is "NO" 163, the routine returns to the alarm on mode 159 and the alarm is continued. If the response to this inquiry is "YES" 165, then the alarm ceases and the routine returns to the set delay pressed inquiry 103. In the alarm on mode 159, the alarm LED 39, preferably red, will provide visual indication of this condition and in the hold/reset pressed conditions 135 and 161, if the response is "YES" 137 or 165, the hold/reset LED 37, preferably amber, will so indicate.

Figure 8:
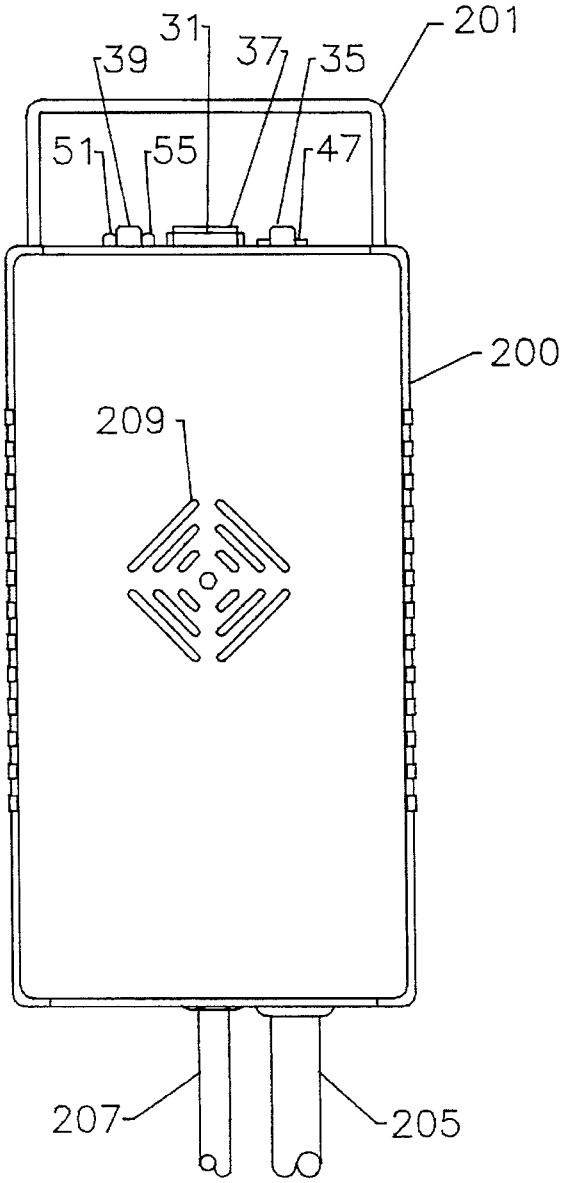
FIG. 8 is a front elevation view of a preferred embodiment of the enclosure of the patient monitoring system.
Figure 9:
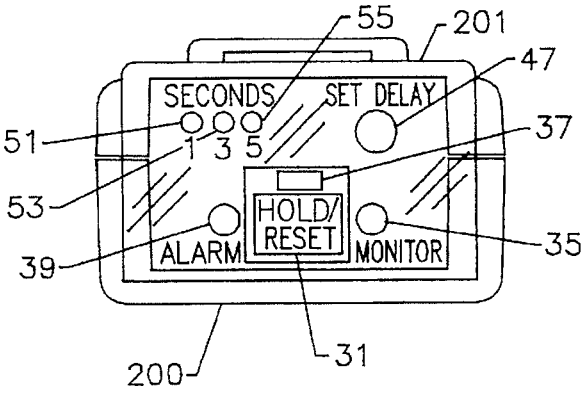
FIG. 9 is a top plan view of the enclosure of FIG. 8.
Figure 10:
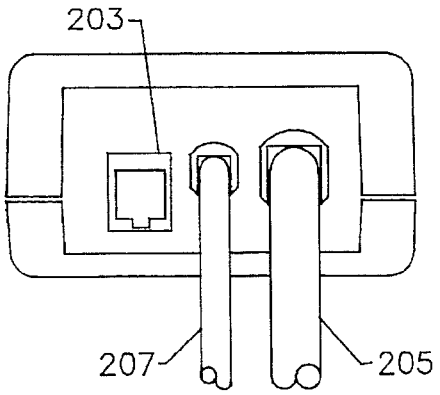
FIG. 10 is a bottom plan view of the enclosure of FIG. 8.
Figure 11:
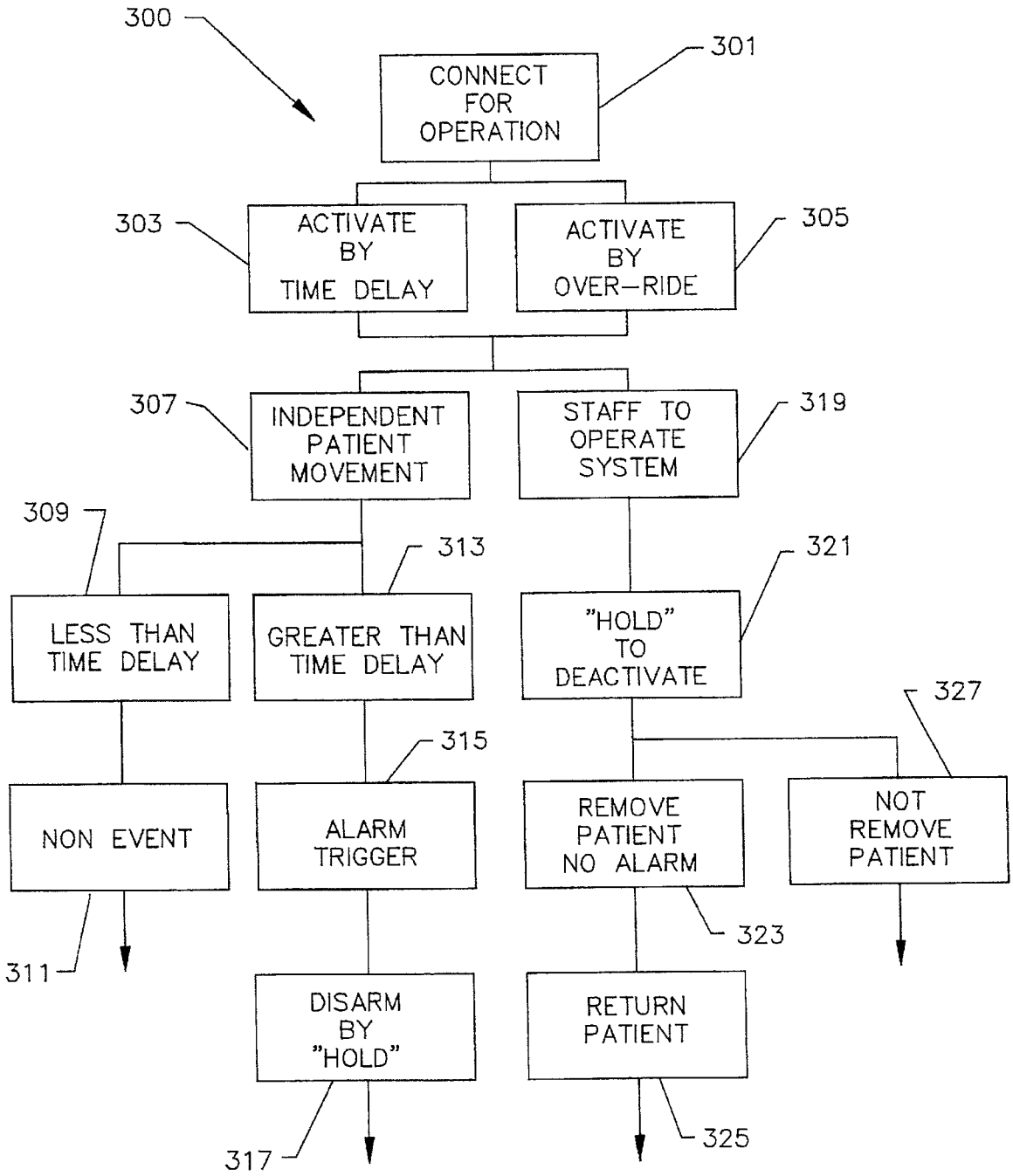
FIG. 11 is a flow chart illustrating the operation of the system from the viewpoint of the monitoring staff.

Turning to FIGS. 8 through 10, the enclosure 200 containing the system is illustrated and preferably approximates two inches in depth, 3 inches in width and 7 inches in height. Preferably, the reset/hold switch 31, the green, amber and red LED's 35, 37 and 39, the delay switch 47 and the delay time LED's 51, 53 and 55 are mounted in the top face of the enclosure 200 under the protection of a clear plastic splashguard 201 which is open at the front to permit access to the switches 31 and 47. A standard four by four phone jack 203 and power and control cables 205 and 207 are preferably mounted in the bottom face of the enclosure 200, the jack 203 for connection to the sensor mat M, the power cable 205 for connection to a power source of either 220 VAC 50 Hz or 110-VAC 60 Hz (not shown) and the control cable 207 for connection to the nurse call station network (not shown). The front face of the unit is provided with apertures 209 for alignment with the audio alarm 11.

Looking at the operation of the system 300 from the viewpoint of the monitoring staff, after the switches 81 have been manipulated to provide the desired programmable features, the monitoring staff can connect the system for operation 301 by attaching it to the physical device to be monitored, such as a hospital bed, and inserting the sensor M into the jack 203. Visual and audio indicia will confirm that the system is in operating condition. If, during the monitoring phase of the system operation, the sensor M becomes disconnected from the system, an alarm will be triggered to indicate the malfunction. The system is automatically activated when pressure is applied to the mat M either by lapse of the built in time delay 303, preferably approximately 10 seconds, or by pressing the hold/reset button 31 to vacate the delay time 305. With the system so activated, if the patient moves independently 307, two possibilities result. If the patient's movement is transient and for a time less than the selected alarm time delay 309, the patient's movement will appear as a non-event 311 to the system. If the patient's movement continues for a time greater than the selected time delay 313, then the alarm will be triggered 315 as soon as the time delay, if any, has elapsed. This will be indicated to the monitoring staff by both the audio and visual operation of the alarm. The alarm can be disarmed 311 only by pressing the hold/reset button 31 and the system will return to the activate by time delay 303 or override 305 condition.

Returning to the activate by time delay and by override conditions 303 and 305, if the staff desires to manipulate the system without triggering an alarm 319, it is necessary only to depress the hold/reset button to deactivate 321 the system. If the staff removes the patient within the delay time 323, no alarm will sound. Upon return of the patient 325, the process returns to the activate by time delay 303 or override 305 condition. If the staff does not remove the patient 327, the process automatically returns to the activate by time delay 303 or override 305 condition.

It should be noted that the above system is especially suited to patient short term or hospital care applications.

Many modifications can be made to the circuits hereinbefore illustrated in conjunction with a preferred embodiment of the system. Greater numbers of programmable switches can be employed to provide greater flexibility in the functional choices available to the monitoring personnel. Internally determined time delays can be established as may be best suitable for the particular application of the system. Many variations are possible with respect to the duration, volume, brightness and type of audio/visual alarm presented.

Thus, it is apparent that them has been provided, in accordance with the invention, a patient bed and chair occupancy monitoring system that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A system connectible to an electrical power source for monitoring a short term care support device having a sensor thereon for detecting the presence of a patient on the device comprising:

a microprocessor;

first circuit means connected to said microprocessor and to the sensor for automatically initiating operation of said microprocessor upon detection by the sensor of the patient's presence on the device;

second circuit means connected to said microprocessor for providing an alarm upon demand by said microprocessor;

third circuit means connected to said microprocessor and adapted to be interfaced with a nurse call station for generating signals to the station upon demand by said microprocessor; and fourth circuit means connected to said microprocessor for controlling said system in response to commands manually applied to said fourth circuit means, said microprocessor being responsive to a program means resident therein for activating said system to a "monitor" mode after a predetermined time delay following detection by the sensor of the patient's presence on the device.

2. A system according to claim 1, said fourth circuit means having means connected therein for providing visual indication when said system is in said "monitor" mode.

3. A system according to claim 1, said microprocessor further being responsive to a first manually operable switching means in said fourth circuit means for deactivating said system to a "hold/reset" mode after activating of said system to said "monitor" mode.

4. A system according to claim 3, said fourth circuit means having means connected therein for providing a visual indication when said system is in said "hold/reset" mode.

5. A system connectible to an electrical power source for monitoring a short term care support device having a sensor thereon for detecting the presence of a patient on the device comprising:

a microprocessor;

first circuit means connected to said microprocessor and to the sensor for automatically initiating operation of said microprocessor upon detection by the sensor of the patient's presence on the device;

second circuit means connected to said microprocessor for providing an alarm upon demand by said microprocessor;

third circuit means connected to said microprocessor and adapted to be interfaced with a nurse call station for generating signals to the station upon demand by said microprocessor; and fourth circuit means connected to said microprocessor for controlling said system in response to commands manually applied to said fourth circuit means, said microprocessor being responsive to a program means resident therein for activating said system to a "monitor" mode after a predetermined time delay following detection by the sensor of the patient's presence on the device and being responsive to a first manually operable switching means in said fourth circuit means for activating said system to said "monitor" mode immediately after detection by the sensor of the patient's presence on the device.

6. A system according to claim 5, said microprocessor further being responsive to said first manually operable switching means in said fourth circuit means for deactivating said system to a "hold/reset" mode for a predetermined period of time following activating of said system and manual operation of said first switching means.

7. A system according to claim 6, said fourth circuit means having means connected therein for providing a visual indication when said system is in said "monitor" mode and means connected therein for providing a visual indication when said system is in said "hold/reset" mode.

8. A system according to claim 6, said microprocessor further being responsive to said first circuit means to activate said system to said "monitor" mode after said system has been deactivated to said "hold/reset" mode and subsequent detection by the sensor of the patient's presence on the device, termination of the patient's presence on the device and resumption of the patient's presence on the device.

9. A system according to claim 6, said microprocessor further being responsive to said first circuit means to activate said system to said "monitor" mode after said system has been deactivated to said "hold/reset" mode and subsequent continuous detection by the sensor of the patient's presence on the device for said predetermined period of time.

10. A system according to claim 6, said microprocessor further being responsive to said first circuit means to switch said system from said "monitor" mode to an "alarm" mode and trigger said second circuit means to provide an alarm a predetermined time after detection by the sensor of termination of the patient's presence on the device.

11. A system according to claim 10, said fourth circuit means having means connected therein for providing a visual indication when said system is in said "alarm" mode.

12. A system according to claim 10, said microprocessor being sequentially responsive to a second manual switching means in said fourth circuit means for selecting said predetermined time from a plurality of preselected different times.

13. A system according to claim 12, said fourth circuit means having a plurality of means connected therein, each for providing a visual indication when said predetermined time is selected from a respective one of said preselected different times.

14. A system according to claim 12, said microprocessor further being responsive to said fourth circuit means for defaulting said second switching means to one of said preselected different times when said system is disconnected from the electrical power source.

15. A system according to claim 10, said microprocessor being responsive to said first manual switching means in said fourth circuit means to switch said system from said "alarm" mode to said "hold/reset" mode and disarm said second circuit means to cease said alarm when said system is in said "alarm" mode and said first manual switching means is operated.

16. A system connectible to an electrical power source for monitoring a short term care support device having a sensor thereon for detecting the presence of a patient on the device comprising:

a microprocessor;

first circuit means connected to said microprocessor and to the sensor for automatically initiating operation of said microprocessor upon detection by the sensor of the patient's presence on the device;

second circuit means connected to said microprocessor for providing an alarm upon demand by said microprocessor, said second circuit means having a plurality of means switchably connectable between said microprocessor and an alarm device for providing different input signals to said alarm device;

third circuit means connected to said microprocessor and adapted to be interfaced with a nurse call station for generating signals to the station upon demand by said microprocessor;

fourth circuit means connected to said microprocessor for operating said system in response to commands manually applied to said fourth circuit means; and fifth circuit means having a plurality of switches connected to said microprocessor for manually programming said microprocessors;

said microprocessor being responsive to a program means resident therein for activating said system to a "monitor" mode after a predetermined time delay following detection by the sensor of the patient's presence on the device and being responsive to said manual programming of said fifth circuit means to connect selected ones of said input signal providing means and selected combinations of said signal providing means to said alarm device.

17. A system connectible to an electrical power source for monitoring a short term care support device having a sensor thereon for detecting the presence of a patient on the device comprising:

a microprocessor;

first circuit means connected to said microprocessor and to the sensor for automatically initiating operation of said microprocessor upon detection by the sensor of the patient's presence on the device;

second circuit means connected to said microprocessor for providing an alarm upon demand by said microprocessor;

third circuit means connected to said microprocessor and adapted to be interfaced with a nurse call station for generating signals generating signals to the station upon demand by said microprocessor, said third circuit means having means switchably connectable between said microprocessor and the nurse call station for adapting said system for electrical interfacing with a nurse call station configuration;

fourth circuit means connected to said microprocessor for operating said system in response to commands manually applied to said fourth circuit means; and fifth circuit means having a plurality of switches connected to said microprocessor for manually programming said microprocessor;

said microprocessor being responsive to a program means resident therein for activating said system to a "monitor" mode after a predetermined time delay following detection by the sensor of the patient's presence on the device and being responsive to said manual programming of said fifth circuit means to adapt said system for electrical interfacing with a selected one of pulsed, continuous and one-shot nurse call station configurations.

18. A system connectible to an electrical power source for monitoring a short term care support device having a sensor thereon for detecting the presence of a patient on the device comprising:

a microprocessor;

first circuit means connected to said microprocessor and to the sensor for automatically initiating operation of said microprocessor upon detection by the sensor of the patient's presence on the device;

second circuit means connected to said microprocessor for providing an alarm upon demand by said microprocessor;

third circuit means connected to said microprocessor and adapted to be interfaced with a nurse call station for generating signals to the station upon demand by said microprocessor; and fourth circuit means connected to said microprocessor for operating said system in response to commands manually applied to said fourth circuit means, said microprocessor being responsive to a program means resident therein for activating said system to a "monitor" mode after a predetermined time delay following detection by the sensor of the patient's presence on the device and being responsive to interruption of operation of said first circuit means after said system is activated to said "monitor" mode to cause said second circuit means to generate an alarm.

19. A system according to claim 18, said interruption of operation of said first circuit means occurring upon any of a. the system being disconnected from the electrical power source;

b. the sensor being disconnected from said first circuit means; and c. the nurse call station being disconnected from said third circuit means.

* * * * *